US008726446B2

(12) United States Patent
Cho

(10) Patent No.: US 8,726,446 B2
(45) Date of Patent: May 20, 2014

(54) DISPOSABLE TOOTHBRUSH

(76) Inventor: Hyunyil Cho, Orangeburg, NY (US)

( * ) Notice: Subject to any disclaimer, the term of this patent is extended or adjusted under 35 U.S.C. 154(b) by 321 days.

(21) Appl. No.: 12/963,592

(22) Filed: Dec. 8, 2010

(65) Prior Publication Data

US 2012/0036665 A1 Feb. 16, 2012

(30) Foreign Application Priority Data

Aug. 16, 2010 (KR) ..... 10-2010-0078693

(51) Int. Cl.
*A46B 9/04* (2006.01)

(52) U.S. Cl.
USPC ..... 15/167.1; 401/268

(58) Field of Classification Search
USPC ..... 15/167.1, 22.1–28; 401/141, 16, 34, 37, 401/268
See application file for complete search history.

(56) References Cited

U.S. PATENT DOCUMENTS 5,339,482 A * 8/1994 Desimone et al. ..... 15/167.1
5,913,682 A * 6/1999 Strate ..... 433/143
6,004,059 A * 12/1999 Zaccaria ..... 401/268
6,108,850 A * 8/2000 McLaughlin ..... 15/167.1
6,957,467 B2 * 10/2005 Cabedo-Deslierres et al. 15/106
8,075,216 B2 * 12/2011 Gatzemeyer et al. ..... 401/288
2004/0163195 A1 * 8/2004 Pao ..... 15/167.2
2008/0148501 A1 * 6/2008 Falk ..... 15/22.1
2009/0320226 A1 12/2009 Robinson et al.

* cited by examiner

*Primary Examiner* — Shay Karls

(74) *Attorney, Agent, or Firm* — Hahn & Voight PLLC; Roger C. Hahn

(57) ABSTRACT

A disposable toothbrush 1 includes a handle portion 2; a head portion 10 connected with the handle portion 2 and provided with a plurality of elastomeric bristles 10*a* at least at the central area of the front surface part; and a fabric medium 20 attached to the front surface part of the head portion 10 while exposing the upper end of the elastomeric bristles 10*a*, and made of a microfiber material provided with at least one kind of a rapidly releasable agent 21. In the toothbrush, the rapidly releasable agent can be stably attached to the fabric medium, and in use, the rapidly releasable agent can be easily separated from the fabric medium, so that the rapidly releasable agent separated from the fabric medium can be easily dissolved to increase the tooth brushing effects.

13 Claims, 2 Drawing Sheets

DISPOSABLE TOOTHBRUSH

BACKGROUND OF THE INVENTION

1. Field of the Invention

The present invention relates to a disposable toothbrush, and more particularly to a disposable toothbrush which can be easily carried by a user when he/she is on a business trip or travel, or going out for a meeting, and wherein it can be conveniently used any place and freely disposed after use.

2. Description of the Prior Art

In general, as a saying that a healthy body can be assured by healthy teeth, having healthy teeth is a barometer of a healthy body. Nonetheless, in the case that people are away from home for a business trip or a travel, or going out for a meeting, most of them dislike carrying the toothbrush because of the relatively large size, and often omitting tooth brushing due to the burden of bringing the toothpaste together with the toothbrush.

Meanwhile, instead of not carrying the toothbrush and the toothpaste, some people purchase an additional toothbrush and toothpaste from a nearby store or a vending machine on site. This might be an economical burden for the individual, and such a thoughtless consumption further causes a waste of resources to the nation.

As an exemplary prior art, the US patent application publication No. 2009-0320226 discloses an oral care implement, wherein a toothpaste storage part is provided at a head portion, and a film matrix is attached to the head portion.

The conventional oral care implement as described above has drawbacks in that a toothpaste lump in a dried form has to be attached to the toothpaste storage part of the head portion, and such a toothpaste lump is relatively large so as not to be easily dissolved. In addition, since the toothpaste storage part is located at the central area of the head portion, which serves mainly for a tooth brushing function, elastomeric bristles cannot be provided at the region occupied by the toothpaste storage part, thereby relatively lowering the tooth brushing effects.

Further, the aforementioned oral care implement has drawbacks in that the film matrix of the head portion is composed of a toothpaste material in a compressed form, which makes it difficult to attach the film matrix to the head portion through the elastomeric bristles. Besides, since the film matrix is in a relatively large form, it is not easily dissolved.

In addition, the conventional oral care implement as described above has drawbacks in that since the film matrix is simply attached to the head portion in a plane versus plane contact, the contacting area therebetween is too small to provide a strong bonding. There is no separate restraining portion to restrict the film matrix with respect to a direction of tooth brushing, so the film matrix is easily detached from the head portion.

Finally, the aforementioned oral care implement is disadvantageous in that a toothpick part provided at the rear end portion thereof is in the form of which the outer diameter becomes smaller from the inside to the outside, which makes it inconvenient to remove foreign materials deeply clogged between the teeth using the toothpick part. Moreover, the toothpick part as such can abruptly exert an excessive force between the teeth, which can widen the gap between the teeth and lead to high risks of damaging the gums.

SUMMARY OF THE INVENTION

Accordingly, the present invention has been made to solve the above-mentioned problems occurring in the prior art, and an object of the present invention is to provide a disposable toothbrush which is easy to carry and provided with at least one kind of a rapidly releasable agent at a head portion, and wherein the rapidly releasable agent is easily dissolved at the time of use.

Another object of the present invention is to provide a disposable toothbrush capable of improving the effects of tooth brushing by providing sufficient elastomeric bristles at the head portion including a rapidly releasable agent.

Further object of the present invention is to provide a disposable toothbrush wherein a medium, to which the rapidly releasable agent is attached, can be easily secured to the head portion without any obstruction of the elastomeric bristles.

A still further object of the present invention is to provide a disposable toothbrush which can relatively simply strengthen the bonding force between the medium accommodating the rapidly releasable agent and the head portion in a structural manner.

A still further object of the present invention is to provide a disposable toothbrush which is able to conveniently remove the foreign materials deeply clogged between the teeth, prevent the gap between the teeth from being widened when removing the foreign materials, and substantially get rid of the risks of damaging the gums.

In order to accomplish this object, there is provided a disposable toothbrush, including: a handle portion; a head portion connected with the handle portion and provided with a plurality of elastomeric bristles at least at the central area of its front surface part; and a fabric medium attached to the front surface part of the head portion while exposing the upper end of the elastomeric bristles and made of a microfiber material provided with at least one kind of a rapidly releasable agent.

The present invention further provides the following detailed examples with respect to the embodiment of the present invention described in the above.

According to a preferred embodiment of the present invention, the rapidly releasable agent is attached to a gap between the microfibers of the fabric medium and the outer surface of the fabric medium.

In accordance with the preferred embodiment of the present invention, the rapidly releasable agent is at least one out of toothpaste and a bad breath remover.

The preferred embodiment of the present invention further includes a plurality of securing protrusions at the periphery of the head portion so as to prevent the fabric medium from derailing outwards in the radial direction of the head portion.

According to the preferred embodiment of the present invention, the respective securing protrusions are composed of a hemisphere-shaped protrusion constituting an upper end portion, and a stem portion integrally connecting the hemisphere-shaped protrusion with the front surface part of the head portion.

In accordance with the preferred embodiment of the present invention, a fabric medium made in a microfiber material with embossing patterns is further provided on the rear surface part of the head portion.

At this point, the rear surface part of the head portion is provided with a plurality of irregular patterns to prevent the fabric medium from derailing outwards.

Meanwhile, the handle portion according to the preferred embodiment of the present invention further includes an inter-dental brush secured to the rear end of the handle portion, and a protective cap detachably coupled to the rear end of the handle portion to protect the inter-dental brush.

Here, the protective cap is made from at least a partially transparent material.

According to the preferred embodiment of the present invention, a knurling part is further provided on the outer surface of the handle portion to increase the contacting force therewith.

In accordance with the preferred embodiment of the present invention, the elastomeric bristles of the head portion are formed in a convex pattern where a central portion thereof is elevated and a remaining portion is lowered.

In accordance with the preferred embodiment of the present invention, the handle portion is provided with a folding or telescopic structure.

Therefore, it should be appreciated that the disposable toothbrush of the present invention is advantageous in that the rapidly releasable agent can be stably attached to the fabric medium by providing the head portion with the fabric medium in a microfiber material to accommodate the rapidly releasable agent such as the toothpaste, the bad breath remover or the like. Further, in use, the rapidly releasable agent can be easily separated from the fabric medium, so that the rapidly releasable agent separated from the fabric medium can be easily dissolved to increase the tooth brushing effects.

In addition, it should be noted here that a plurality of elastomeric bristles are provided at least at the central area of the front surface part of the head portion to improve the effects of tooth brushing, and a plurality of securing protrusions are provided on the front surface part of the head portion to strengthen the bonding force between the fabric medium and the front surface part of the head portion in a structural manner.

Moreover, it should be appreciated that the inter-dental brush is provided at the rear end of the handle portion, so as to conveniently remove the foreign materials deeply clogged between the teeth, prevent the gap between the teeth from being widened when removing the foreign materials, and substantially get rid of the risks of damaging the gums.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
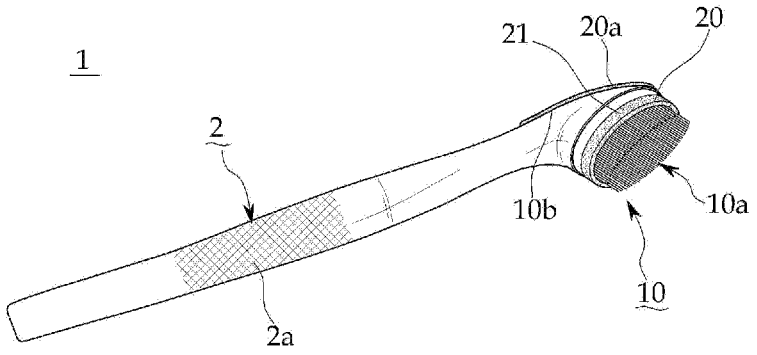
FIG. 1 is a schematic perspective view illustrating a disposable toothbrush in accordance with a first embodiment of the present invention.

Hereinafter, a first to fourth preferred embodiments of the present invention will be described with reference to the accompanying drawings, FIGS. 1 to 4. In the following description and drawings, the same reference numerals are used to designate the same or similar components, and so repetition of the description on the same or similar components will be omitted.

Referring to FIG. 1, a disposable toothbrush 1 of the present invention includes a handle portion 2, a head portion 10, and a fabric medium 20.

The head portion 10 is connected with the handle portion 2 and provided with a plurality of elastomeric bristles 10*a* at least at the central area of the front surface part thereof. The fabric medium 20 is made from a microfiber material and attached to the front surface part of the head portion 10, while exposing the upper end of the elastomeric bristles 10*a*. The fabric medium 20 is provided with at least one kind of a rapidly releasable agent 21.

Meanwhile, during the assembling operation of the fabric medium 20 with the head portion 10, it is desirable to use a separate assembling tool (not shown) which can make a plurality of coupling holes, corresponding to the elastomeric bristles 10*a* of the head portion 10, at the fabric medium 20 so as to easily attach the fabric medium 20 to the head portion 10.

In the disposable toothbrush 1 according to the present invention as constructed above, since fabric medium 20 in a microfiber material to accommodate the rapidly releasable agent 21 is provided at the head portion 10, the rapidly releasable agent 21 can be stably attached to the fabric medium 20. In use, the rapidly releasable agent 21 can be easily dissolved by the absorbing action of the fabric medium 20, increasing the tooth brushing effects. Besides, the disposable toothbrush 1 of the present invention has a construction in that a plurality of elastomeric bristles 10*a* are provided at least at the central area of the front surface part of the head portion 10, so the effects of tooth brushing can be enhanced through the sufficient number of the elastomeric bristles 10*a*.

The disposable toothbrush of the present invention having a basic construction as mentioned above can be further embodied in more defined patterns as described in the detailed embodiments below.

As an exemplary embodiment, referring to FIG. 1, the rapidly releasable agent 21 can be attached to the gap created between the microfibers of the fabric medium 20 and to the outer surface of the fabric medium 20 in a thin-film form or a dispersed form. When the rapidly releasable agent 21 is attached to the fabric medium 20 as such, the rapidly releasable agent 21 can be relatively well dissolved in the saliva or water with the help of the absorbing action of the fabric medium 20, compared with an agent solidified in the form of a large lump or a film, thereby improving the tooth brushing effects.

At this point, the rapidly releasable agent 21 may be composed of at least one out of toothpaste and a bad breath remover. The toothpaste or the bad breath remover is composed of a mixture of a plurality of ingredients, in which the mixture is attached to the fabric medium 20 in a stable manner. Further, the mixture is well preserved in a particle form in the air, while being composed of an easily dissoluble form upon contacting the saliva or water.

Figure 2:
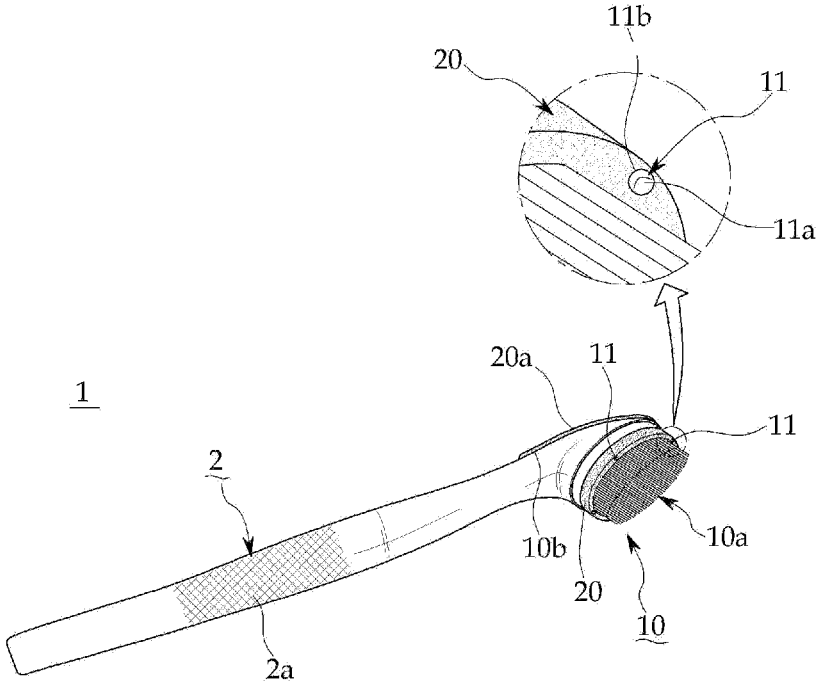
FIG. 2 is a schematic partially enlarged perspective view illustrating a disposable toothbrush in accordance with a second embodiment of the present invention.

Referring to FIG. 2, as an exemplary embodiment, preferably a plurality of securing protrusions 11 are further provided at the periphery of the head portion 10 so as to supplementarily prevent the fabric medium 20 from derailing outwards in the radial direction of the head portion 10. The respective securing protrusions 11 may be composed of a hemisphere-shaped protrusion 11*a* which constitutes an upper end portion, and a stem portion 11*b* which integrally connects the hemisphere-shaped protrusion 11*a* with the front surface part of the head portion 10. Hence, such a securing protrusion structure can strengthen the bonding force between the fabric medium 20 and the front surface part of the head portion 10 with the securing force between the fabric medium 20 and the securing protrusions 11.

As an exemplary embodiment, a fabric medium 20*a* made in a microfiber material with embossing patterns may be further attached to the rear surface part of the head portion 10. The fabric medium structure on the rear surface part of the head portion allows a user to conveniently scrub his/her tongue or gums using the fabric medium 20*a* on the rear surface part of the head portion 10.

Preferably, as an exemplary embodiment, a plurality of irregular patterns 10*b* are formed on the rear surface part of the head portion 10 in order to prevent the fabric medium 20*a* from derailing outwards. Such an irregular pattern structure serves to increase the contacting area therebetween, so as to enhance the bonding force between the fabric medium 20*a* and the rear surface part of the head portion 10.

Figure 3:
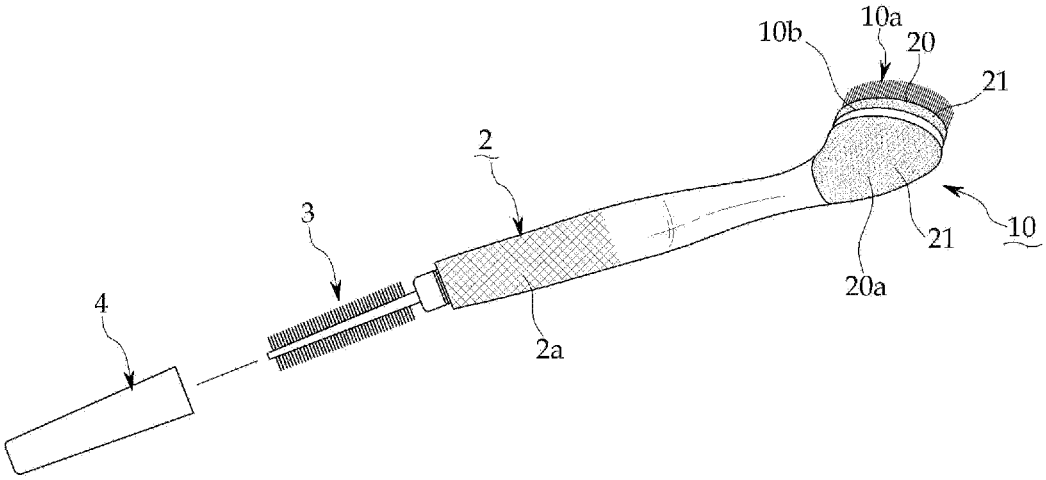
FIG. 3 is a schematic exploded view illustrating a disposable toothbrush in accordance with a third embodiment of the present invention.

Referring to FIG. 3, as an exemplary embodiment, the handle portion 2 may be further provided with an inter-dental brush 3 secured to the rear end of the handle portion 2, and a protective cap 4 detachably coupled to the rear end of the handle portion 2 to protect the inter-dental brush 3. Further, it is desirable that the protective cap 4 is made from a transparent material so as to apparently expose the inter-dental brush 3 provided at the rear end of the handle portion 2. Such constructions may have effects to visually appeal the features of the disposal toothbrush 1 of the present invention to the consumer in a natural manner. Meanwhile, the handle portion 2 and the inter-dental brush 3 may be simply manufactured with insert molding techniques.

The inter-dental brush structure of the handle portion as described above allows the user to easily remove the foreign materials, which are clogged in the gap formed between the teeth, using the inter-dental brush 3 provided at the rear end of the handle portion 2.

As an exemplary embodiment, referring to FIG. 3, it is preferable that a knurling part 2*a* is further formed on the outer surface of the handle portion 2 to increase the contacting force therewith. Such a knurling part structure can prevent the handle portion 2 from being abruptly slipped and derailed from the user's hand, when the user uses the inventive disposable toothbrush having a relatively shorter length compared with the conventional toothbrush.

Figure 4:
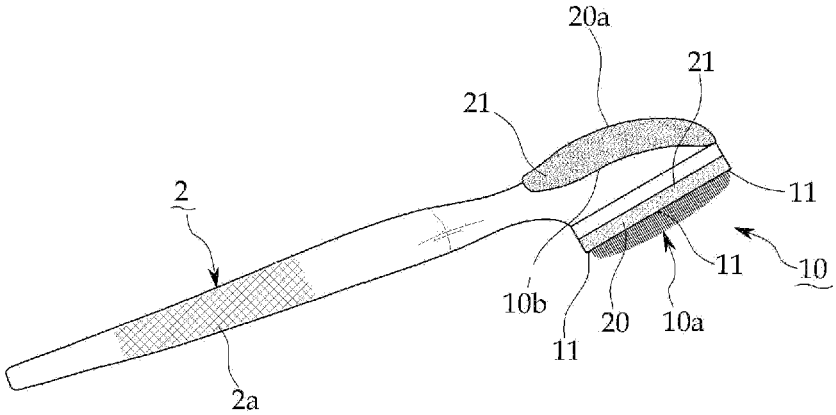
FIG. 4 is a schematic perspective view illustrating a disposable toothbrush in accordance with a fourth embodiment of the present invention.

Referring to FIG. 4, as an exemplary embodiment, the elastomeric bristles 10*a* of the head portion 10 may be formed in a convex pattern where the central portion is elevated and the remaining portion is lowered. Such a convex structure of the elastomeric bristles can improve the contacting probability between the elastomeric bristles 10*a* and the teeth even when the user brushes his/her teeth in an inclined posture with respect to the ground, thereby enhancing the effects of tooth brushing.

Meanwhile, as an exemplary embodiment, the handle portion 2 can be provided with a folding or telescopic structure. Such a folding or telescopic structure makes it easy to carry the inventive disposable toothbrush.

Operation of the embodiment of the inventive disposable toothbrush constructed as the above will be described with reference to FIGS. 1 to 4 hereinafter.

Since the size of the disposable toothbrush 1 in accordance with the present invention is about half of the conventional toothbrush, it is easy to carry the same in the pocket or the like, and then take out from the pocket, if necessary, which makes it convenient to use the disposable toothbrush 1.

For instance, when the user feels unpleasant with his/her mouth or after having a meal, he/she can brush his/her teeth using the head portion 10 of the disposable toothbrush 1 after dipping the head portion 10 in his/her mouth or wetting the head portion 10 in water, while grasping the handle portion 2 of the disposable toothbrush 1.

At this moment, the rapidly releasable agent 21 attached to the fabric medium 20, for example, at least one of the toothpaste or the bad breath remover is dissolved in saliva or water, so as to help the tooth brushing operations.

In addition, it can be appreciated that the user can scrub the outer surface of his/her tongue, gums or the like using the fabric medium 20*a* attached to the rear surface part of the head portion 10, easily removing the foreign materials clung to the outer surface of his/her tongue, gums or the like.

Meanwhile, as another exemplary embodiment, when the foreign materials are deeply clogged in the gap between the teeth, the user can remove the protective cap 4 from the rear end of the handle portion 2 of the disposable toothbrush 1, and then conveniently remove the foreign materials present in the gap between the teeth using the inter-dental brush 3 provided at the rear end of the handle portion 2. Moreover, inter-dental brush 3 of the handle portion 2 prevents the gap between the teeth from being widened, and substantially gets rid of the risks of damaging the gums.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A disposable toothbrush comprising:

a handle portion;

a head portion connected with the handle portion and provided with a plurality of elastomeric bristles at least at a central area of its front surface part; and a fabric medium attached to the front surface part of the head portion while exposing an upper end of the plurality of elastomeric bristles, and the fabric medium being made of a microfiber material provided with at least one kind of a rapidly releasable agent.

2. The disposable toothbrush as recited in claim 1, wherein the rapidly releasable agent is attached to a gap between the microfibers of the fabric medium and an outer surface of the fabric medium.

3. The disposable toothbrush as recited in claim 1 or 2, wherein the rapidly releasable agent is at least one out of toothpaste and a bad breath remover.

4. The disposable toothbrush as recited in claim 1, further comprising a plurality of securing protrusions at the periphery of the head portion so as to prevent the fabric medium from derailing outwards in a radial direction of the head portion.

5. The disposable toothbrush as recited in claim 4, wherein the plurality of securing protrusions are composed of a hemisphere-shaped protrusion constituting an upper end portion, and a stem portion integrally connecting the hemisphere-shaped protrusion with the front surface part of the head portion.

6. The disposable toothbrush as recited in claim 1, further comprising a fabric medium made of a microfiber material with embossing patterns on a rear surface part of the head portion.

7. The disposable toothbrush as recited in claim 6, wherein a plurality of irregular patterns are provided on the rear surface part of the head portion to prevent the fabric medium from derailing outwards.

8. The disposable toothbrush as recited in claim 1, wherein the handle portion further includes an inter-dental brush secured to a rear end of the handle portion, and a protective cap detachably coupled to the rear end of the handle portion to protect the inter-dental brush.

9. The disposable toothbrush as recited in claim 8, wherein the protective cap is made from at least a partially transparent material.

10. The disposable toothbrush as recited in claim 1, wherein a knurling part is further provided on an outer surface of the handle portion to increase the contacting force therewith.

11. The disposable toothbrush as recited in claim 1, wherein the elastomeric bristles of the head portion are formed in a convex pattern such that the elastomeric bristles have a central portion elevated relative to a remaining portion.

12. The disposable toothbrush as recited in claim 1, wherein the handle portion is provided with a folding or telescopic structure.

13. The disposable toothbrush as recited in claim 1, wherein the rapidly releasable agent is configured as a thin film.

* * * * *